US005303452A

United States Patent [19]

Genevray

[11] Patent Number: 5,303,452

[45] Date of Patent: Apr. 19, 1994

[54] WOOL CARD

[75] Inventor: Henri Genevray, Guebwiller, France

[73] Assignee: N. Schlumberger Et Cie, S.A., Guebwiller, France

[21] Appl. No.: 894,945

[22] Filed: Jun. 8, 1992

[30] Foreign Application Priority Data

Jun. 7, 1991 [FR] France ..... 91 07111

[51] Int. Cl.[5] ..... D01B 1/00

[52] U.S. Cl. ..... 19/84; 19/99

[58] Field of Search ..... 19/98, 99, 85, 87, 93, 19/100, 101, 84

[56] References Cited

U.S. PATENT DOCUMENTS

| | | | |
|---|---|---|---|
| 318,121 | 5/1885 | Klein | 19/84 |
| 2,009,282 | 7/1935 | Thibeau | 19/84 |
| 2,115,605 | 4/1938 | Allen et al. | 19/84 |
| 2,189,519 | 2/1940 | Harrison et al. | 19/84 |
| 2,478,799 | 8/1949 | Wilkinson | 19/98 |

FOREIGN PATENT DOCUMENTS

| | | |
|---|---|---|
| 165596 | 1/1904 | Fed. Rep. of Germany . |
| 651029 | 2/1929 | France . |
| 992485 | 10/1951 | France . |
| 626713 | 7/1949 | United Kingdom . |
| WO91/09164 | 6/1991 | World Int. Prop. O. . |

*Primary Examiner*—Clifford D. Crowder
*Assistant Examiner*—Michael A. Neas
*Attorney, Agent, or Firm*—Young & Thompson

[57] ABSTRACT

The present invention concerns a wool card applicable in the field of the textile industry. The card is characterized in that it is equipped with at least three Morel rollers (1), in that it does not have an intermediate comb and in that the tangential velocities of the feeder rollers (2) and the large drum (3) are equal, the reduction in speed of the fiber web between the large drum (3) and the following Morel roller (1) being relatively low.

1 Claim, 1 Drawing Sheet

Fig_2
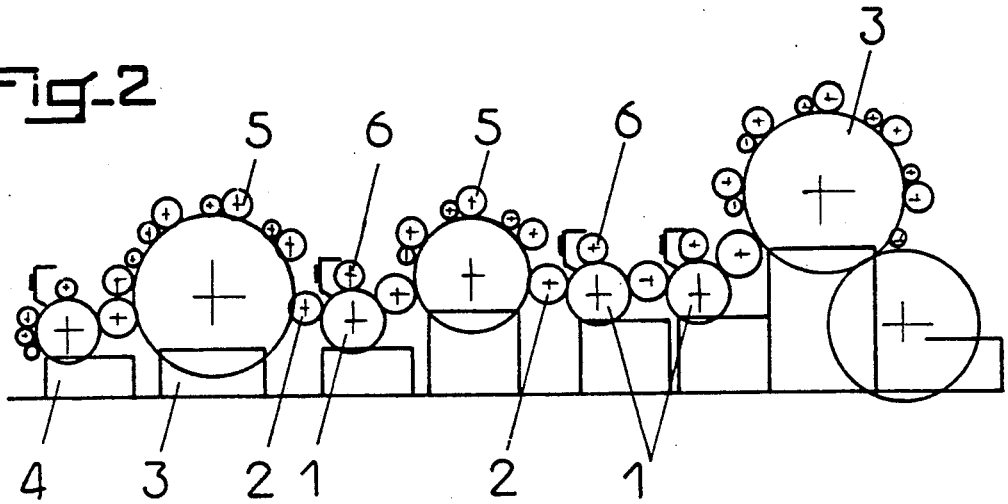
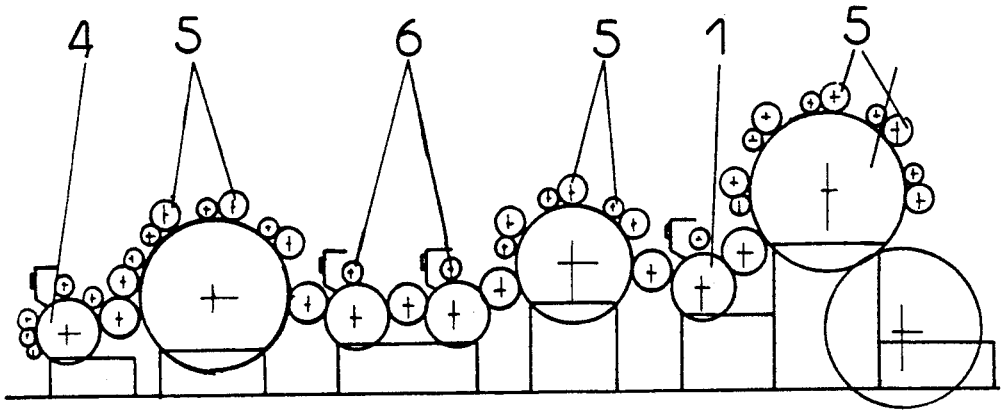
Fig_1
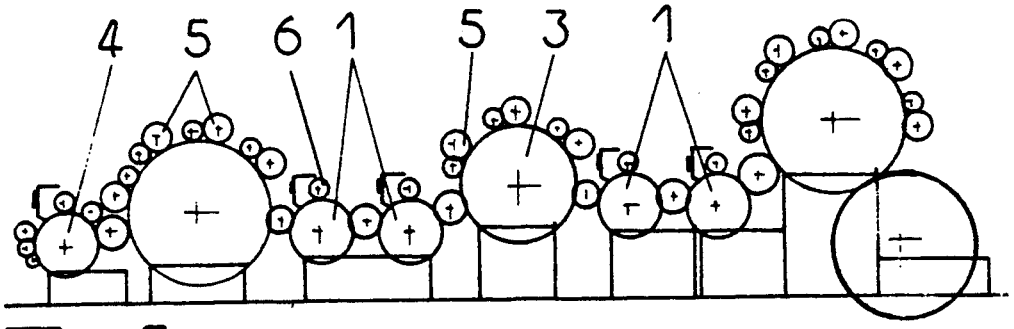
Fig_3

WOOL CARD

The present invention concerns the field of the textile industry, and, more particularly, has for its object the wool cards working wool and long fibers.

At present, the existing cards of this type are generally double cards with an intermediate comb displaying a substantial reduction in speed and a high purification capability.

Such a configuration has the drawback of provoking the shortening of the fibers, which is very prejudicial to the finished product, because, in a general manner, to obtain a thread of optimal quality, one must strive to obtain and to keep fibers of a maximum length.

In these existing cards, use is generally made of two Morel rollers mounted in tandem or in another manner.

To obtain the worsted effect, the speed of the fiber web to treat is reduced before each Morel roller, between the feeder roller and the large drum, in such a manner that the orientation of the impurities contained in the fiber web are modified so that the burr beater of the corresponding Morel roller eliminates them.

However, using this reduced number of Morel rollers has the drawback, on the one hand, of allowing the obtainment of a relatively unclean product only and, on the other hand, because of this reduced number of rollers, the necessary reduction in speed at the level of each Morel roller is very substantial and leads to a breakage of the fibers, which is considerably injurious to the quality of the obtained product.

A substantial reduction of speed at the level of each Morel roller is more particularly necessary because a maximum quantity of impurities, such as burrs, straws or other vegetable fibers, must be torn from the accumulated web on each Morel roller upon its passage under the corresponding burr beater.

In addition, because of the substantial reduction in speed at the level of each Morel roller, the fiber web emerges at a relatively low speed, which leads to a relatively low yield.

The goal of the present invention is to extenuate these drawbacks.

This invention thus has for its object a wool card characterized in that it is equipped with at least three Morel rollers, in that it does not have an intermediate comb and that the tangential velocities of the feeder rollers and of the large drum are equal, the reduction in speed of the fiber web between the large drum and the following Morel roller being relatively low.

The invention will be better understood thanks to the following description, which concerns the preferred embodiments, given as non-limiting examples and explained with reference to the attached schematic drawings, in which:

FIG. 1 is a lateral elevation view of a card conforming with the invention and, FIGS. 2 and 3 are analogous views to that of FIG. 1 and are alternative embodiments of the invention.

In accordance with the invention, and more particularly, as FIGS. 1 to 3 of the attached drawings show, the wool card is equipped with at least three Morel rollers 1 and the tangential velocities of the feeder rollers 2 and of the large drum 3 are equal, the reduction in speed of the fiber web between the large drum 3 and the following Morel roller 1 being relatively low. In addition, this card does not have an intermediate comb.

As FIG. 1 of the attached drawings shows, the card conforming to the invention may display the following arrangement: a licker 4 followed by a large drum 3 with four worker carding units 5, this large drum cooperating, by the intermediary of a feeder roller 2 with a first Morel roller 1 having a burr beater 6 and followed, with the interposition of another feeder roller 2 by a second Morel roller 1.

Following this Morel roller 1 is provided a second large drum 3 equipped with three worker carding units 5, this large drum 3 being once again connected to a Morel roller 1 with burr beater 6 with the aid of another feeder roller 2, this latter Morel roller 1 being itself connected, by intermediary of a feeder roller 2, to a last large drum 3 equipped with five worker carding units 5.

In this embodiment, the fiber web originating from the licker 4 is brought by the large drum 3 and the feeder roller 2, at constant speed, to the first Morel roller 1 whose tangential velocity is less than that of the feeder roller 2, in such a way that the web is braked and has the tendency to accumulate fibers over a larger thickness and, because of that fact, to favor a straightening out of the impurities, permitting their extraction by the burr beater 6.

The web may then be transmitted at constant speed to the second Morel roller 1 for a second burr removal operation to remove the impurities. At the outlet of the second Morel roller, the web, picked up by the following feeder roller 2, is accelerated and thus stretched out to be treated on the following large drum 3 before undergoing a new deceleration for treatment on the third Morel roller 1. At the outlet of the latter, the web is once again accelerated to undergo its last stretching out.

FIG. 2 of the attached drawings represents an embodiment of the invention in which the location of the Morel rollers 1 with respect to the large drum 3 equipped with three worker carding units 5 is reversed.

Finally, FIG. 3 represents another embodiment of the invention using four Morel rollers arranged in tandem between the first large drum 3 and the last large drum 3. In this embodiment, the fiber web may be treated at a higher speed because the burr removal process is distributed in four operations corresponding to the four Morel rollers.

According to an embodiment of the invention not represented in the attached drawings, it is equally possible to place the Morel rollers 1 in superposed pairs between two large drums 3. Such an embodiment allows a substantial limitation of the size of the card in the longitudinal direction.

Thanks to the invention, it is possible to realize a card not needing an intermediate comb and having a high cleaning capability while preserving the fibers from breakage, these fibers being, because of this fact, of better quality. The end result is that the obtained product is a better refined product.

In addition, the provision of a number of Morel rollers at least equal to three, allows a substantial distribution of the extraction of the burrs and other impurities, and thus to limit the reduction of the tangential velocity of the fiber web with an accumulation over a lesser thickness, in such a way that the treatment speed of the web is increased, which leads to a corresponding increase in the output of the machine.

It is to be understood that the invention is not limited to the embodiments described and represented in the attached drawings. Modifications remain possible, notably in the constitution of the various elements, or by substituting technical equivalents without thereby departing from the scope of protection of the invention.

What is claimed is:

1. A wool card comprising at least three Morel rollers (1), feeder rollers (2) between the Morel rollers and three large drums (3) between which the Morel rollers are disposed, the wool card being free from intermediate combs, the feeder rollers and the large drums having equal tangential velocities, a pair of said Morel rollers (1) being disposed in immediate sequence between two of said large drums with only one feeder roller between them, a third Morel roller being disposed on a side of one of said two large drums opposite said pair of Morel rollers and between one of said two large drums and the third large drum, the Morel rollers of said pair being spaced whereby all of the fiber web from one of said pair of Morel rollers passes over said one feeder roller and thence to the other of said pair of Morel rollers.

* * * * *